US009806479B2

(12) United States Patent
Pizzi

(10) Patent No.: US 9,806,479 B2
(45) Date of Patent: Oct. 31, 2017

(54) EARTHING CONDUCTOR ELEMENT FOR SWITCHBOARD TERMINAL BLOCKS AND ASSOCIATED TERMINAL BLOCK FOR EARTHING EARTH WIRES

(71) Applicant: Morsettitalia S.p.A., Milan (IT)

(72) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 15/015,953

(22) Filed: Feb. 4, 2016

(65) Prior Publication Data

US 2017/0025804 A1 Jan. 26, 2017

(30) Foreign Application Priority Data

Feb. 5, 2015 (IT) ..... MI2015A0152

(51) Int. Cl.

| | |
|---|---|
| ***H01R 9/22*** | (2006.01) |
| ***H01R 25/14*** | (2006.01) |
| ***H01R 9/26*** | (2006.01) |
| ***H01R 9/24*** | (2006.01) |
| ***H01R 13/627*** | (2006.01) |

(52) U.S. Cl.

CPC ..... *H01R 25/142* (2013.01); *H01R 9/2483* (2013.01); *H01R 9/2675* (2013.01); *H01R 9/2691* (2013.01); *H01R 13/627* (2013.01)

(58) Field of Classification Search

CPC ..... H01R 9/24; H01R 13/514; H01R 9/26; H01R 9/2608; H01R 9/2675; H01R 9/2625; H01R 4/64; H01R 25/142

USPC ..... 439/94, 709, 716, 715, 110, 121

See application file for complete search history.

(56) References Cited

U.S. PATENT DOCUMENTS

| | | | | |
|---|---|---|---|---|
| 4,454,382 A * | 6/1984 | Borne | H02B 1/052 174/158 R |
| 5,049,094 A | 9/1991 | Heng et al. | |
| 5,174,767 A | 12/1992 | Diekmann et al. | |
| 5,890,916 A | 4/1999 | Diekmann et al. | |
| 6,183,311 B1 * | 2/2001 | Suess | H01R 4/4845 439/716 |

(Continued)

FOREIGN PATENT DOCUMENTS

DE 4409206 C1 5/1995

OTHER PUBLICATIONS

Written Opinion issued in Int'l Application No. MI2015A000152 on Sep. 23, 2015.

*Primary Examiner* — Hae Moon Hyeon

(74) *Attorney, Agent, or Firm* — Mintz Levin Cohn Ferris Glovsky and Popeo, P.C.

(57) ABSTRACT

A conductor element includes a conductor lamina designed to electrically connect together two wires and a substantially vertical shaped body extending in the longitudinal direction. The substantially vertical shaped body including a bottom body section having a bottom free edge, a first end, a second end, and a flat-lamina spring. The bottom free edge extends in the longitudinal direction for resting in the vertical direction on a DIN-standard rail. The first end includes a tooth to engage with one of the two folded flanges of the DIN standard rail (B). The second end is opposite to the first end and is designed for engaging and retaining the flat-lamina spring. The flat-lamina spring includes a head and two flat-pins legs for engagement with the other folded flange of the rail.

16 Claims, 4 Drawing Sheets

(56) References Cited

U.S. PATENT DOCUMENTS

| | | | | |
|---|---|---|---|---|
| 6,471,552 | B2 * | 10/2002 | Bechaz | H01R 9/2691 267/160 |
| 7,666,037 | B2 * | 2/2010 | Diessel | H01R 9/2616 439/716 |
| 7,922,521 | B1 | 4/2011 | Wu | |
| 8,231,391 | B2 * | 7/2012 | Boecker | H01R 9/2608 439/94 |
| 2003/0203671 | A1 | 10/2003 | Suess | |
| 2007/0049129 | A1 | 3/2007 | Pollmann | |
| 2017/0025805 | A1 * | 1/2017 | Pizzi | H01R 9/2675 |

* cited by examiner

E
100
121a
110a
110
115a
115
110b
115
121
120
122
Ω
123
127
130
124
131
131a
132
132b
132a
132b
125
150
123a2
123a
150
123a1
124b
124a
z
y
x
x
y
z

α
127
126a
125a
126
123a2
123a
132
132b
B2
B

α
123a
125
125a
127
125b
126a
126
126b
123
123a

EARTHING CONDUCTOR ELEMENT FOR SWITCHBOARD TERMINAL BLOCKS AND ASSOCIATED TERMINAL BLOCK FOR EARTHING EARTH WIRES

RELATED APPLICATIONS

This application claims priority under 35 U.S.C. §119 to Italian Patent Application No. MI2015A000152 filed Feb. 5, 2015, the entire content of which is hereby incorporated by reference herein.

FIELD

The present subject matter relates to a switchboard terminal block for connecting ground electric wires to a corresponding common reference point.

BACKGROUND

It is known, in the technical sector relating to the production of switchboards for the wiring of electrical installations, to use terminal blocks designed to be mounted on associated supports and to provide on the front side access to the retaining means—normally of the screw or spring type—for electric wires to be connected in order to ensure continuity of the various sections of the electric circuit. The continuity achieved by inserting inside a special seat, accessible from the front, movable contact elements such as protection fuses, electric circuit breakers or jumpers for connecting together two adjacent terminal blocks. It is also known that at least one of the terminal blocks of the switchboard must be used for the connection to ground of the respective wires of the circuit.

According to the prior art such a ground connection is obtained by means of terminal blocks, a conductor lamina of which is electrically connected to the DIN rail supporting the terminal block assembly.

DE 44 09 206 C1 describes a grounding conductor element.

SUMMARY

The technical problem which is posed, therefore, is that of providing a terminal block, in particular of the type used in switchboards for wired circuits, which allows the user to perform the ground connection of the associated ground wires, by means of DIN support rails, in an easy, reversible and safe way, while maintaining the necessary conductive capacity for the protection and safety of the system installed. In connection with this problem, this terminal block should maintain the standard dimensions imposed by the connections and should be easy and inexpensive to produce and assemble.

These results are obtained according to the present subject matter by a grounding conductor element for switchboard terminal and by a terminal block for grounding electric wires.

DESCRIPTION OF THE DRAWINGS

Further details may be obtained from the following description of a non-limiting example of embodiment of the present subject matter, provided with reference to the accompanying drawings, in which.

DETAILED DESCRIPTION

Figure 1:
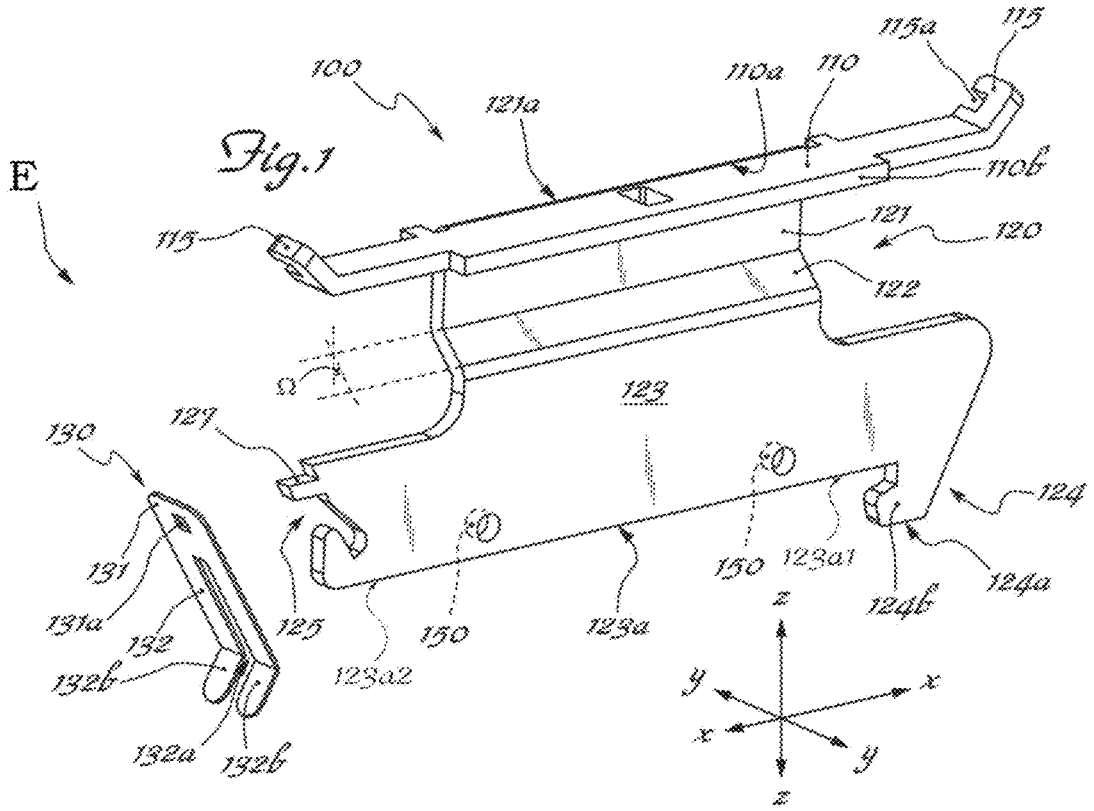
FIG. 1 shows an exploded perspective view of a conductor element for switchboard terminal blocks according to the present subject matter.

As shown in FIG. 1 the conductor element E includes a conductor body 100. The conductor body 100 includes a conductor lamina 110 and a substantially vertical shaped body 120. The conductor lamina 110 extends in the longitudinal direction X-X and is designed to electrically connect together in the longitudinal direction two wires 2 inserted on opposite sides of a terminal block 10.

The substantially vertical shaped body 120 extends in the longitudinal direction X-X. The substantially vertical shaped body 120 includes a substantially vertical top body section 121, a second section 122, and a substantially vertical bottom section 123. The substantially vertical top body section 121 includes an edge 121*a*—situated at the top according to the layout shown in the figure—for connecting in the transverse direction Y-Y to a longitudinal edge 110*a* of the conductor lamina 110 with which it forms one piece. The second section 122 is inclined with respect to the vertical top section 121 from the top downwards and from the conductor lamina 110 longitudinal edge 110*a* towards a free edge 110*b* of the conductor lamina 110 at a suitable angle Ω. The substantially vertical bottom section 123 has its top edge connected to the inclined second section 122 and includes a free bottom edge 123*a* for resting on the top surface of both folded flanges B1,B2 of a DIN-standard rail B, by means of a first edge section 123*a*1 and a second edge section 123*a*2. First edge section 123*a*1 and second edge section 123*a*2 are situated opposite each other in the longitudinal direction X-X and aligned in the vertical direction Z-Z for conductively resting on a respective one B1;B2 of the folded flanges of the DIN-standard rail B. The bottom section 123 can be arranged in a vertical plane within the width of the conductor lamina 110 in the transverse direction Y-Y, and can be substantially parallel to the free edge 110*b* of the conductor lamina 110, opposite to that edge 110*a* connected to the first section 121.

The bottom section 123 of the conductor element E includes a first end 124 and a second end 125. The first end 124 is proximal to and integral with the first section 123*a*1 of the edge 123*a*; a bottom edge 124*a* of first end 124 has a first tooth 124*b* projecting beyond the free bottom edge 123*a* in the vertical direction Z-Z and extending in the longitudinal direction X-X and inwards and designed to engage with one B1 of the two folded flanges B1,B2 of a DIN-standard rail B.

The second end 125 is opposite to the first end 124, proximal to and integral with the second edge section 123*a*2.

Figure 2:
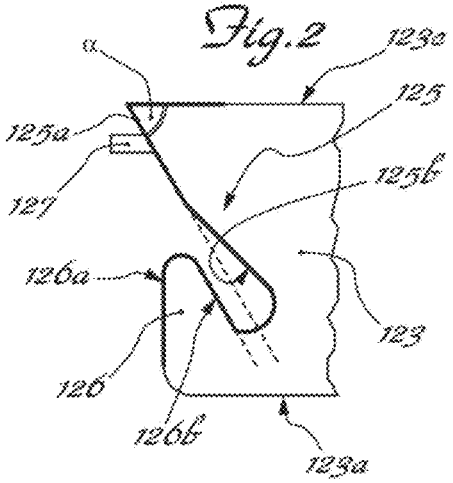
FIG. 2 shows a detailed side view of the form of one of the two longitudinal ends of the conductor element according to FIG. 1.
Figure 4:
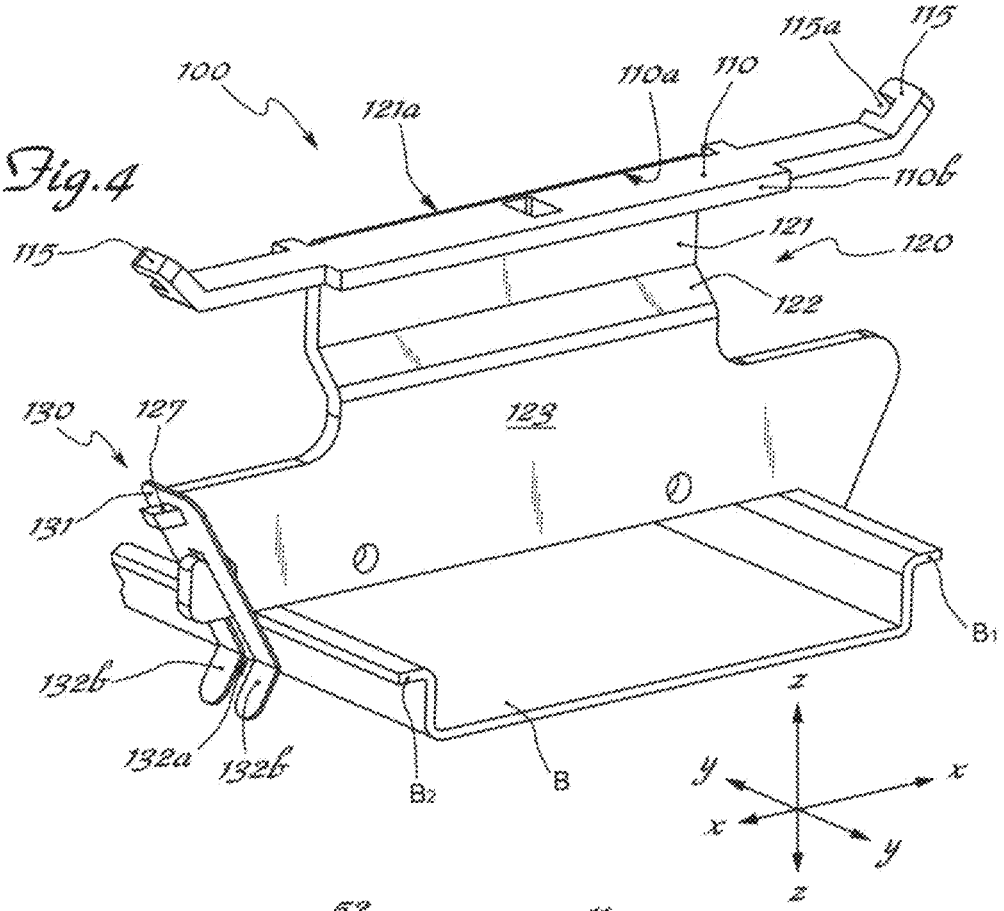
FIG. 4 shows a perspective view of the conductor element mounted on a switchboard DIN-standard rail.

The second end 125 has, from the top downwards (with reference to FIG. 2) a first edge 125*a*, a second edge 125*b*, and a second tooth 126. The first edge 125*a* is inclined at a suitable angle α with respect to a horizontal longitudinal edge 123*c* parallel to the bottom free edge 123*a* of the bottom body section 123. The first edge 125*a* can have a pin 127, which extends outwards in the longitudinal direction X-X. The second edge 125*b* is inclined inwards at a suitable obtuse angle with respect to the first edge 125*a*. The second tooth 126 includes an outer edge 126*a*, which is substantially parallel to the vertical direction Z-Z and an inner edge 126*b*, which is on the outside of and parallel with the first edge 125*a* and connected to the second edge 125*b* of second end 125.

Overall, the second end 125 of the conductor element E shaped body 120 according to the present subject matter forms an engaging and retaining means for a flat-lamina spring 130. The flat-lamina spring 130 has a head 131 and two flat-pin legs 132. The head 131 includes an opening 131*a* for coupling with the pin 127 of the second end 125 of the conductor element E. The two flat-pin legs 132 are separated by an interspace 132*a*. The two flat-pin legs 132 can have a respective free end forming a tongue 132*b* inclined outwards at a suitable angle, for facilitating engagement with the DIN-standard rail B and for allowing operation thereof for disengagement from said DIN-standard rail B.

Figure 3:
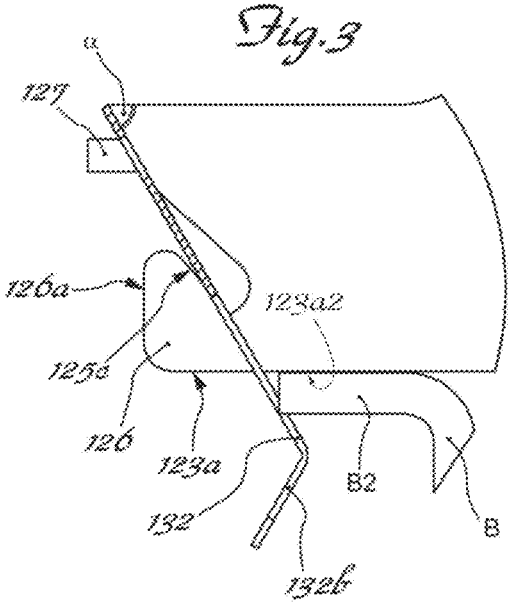
FIG. 3 shows a detailed side view of the conductor element assembled together with a flat-lamina spring for engagement on a DIN rail.

As shown in FIG. 3, mounting of the flat-lamina spring 130 on the second end 125 of the conductor element E causes relative coupling of the pin 127 with the opening 131*a* in the head 131 of the flat-lamina spring 130 and resting of the head 131 on the inclined first edge 125*a* of the second end 125; as well as resting of the bottom edge of the head 131, coinciding with the interspace top edge, on the edge inner 126*b* of the second tooth 126 of the second end 125. In this way the resilient flat-lamina spring 130 is arranged with the same inclination determined by the angle α of the first edge 125*a* so as to cause the free ends of the legs 132 to make contact with and push from the outwards inwards on the folded flange B2 of the DIN-standard rail B opposite to the flange B1 engaging with the tooth 124*b* of the shaped body 120 first end 124.

Pin 127 may be riveted so as to ensure the fixing and stability of the coupling with flat-lamina spring 130. In order to perform engagement with the DIN-standard rail B it is sufficient to exert a pressure on the flat-lamina spring 130 so as to produce a resilient deformation of the flat-pin legs 132 which, reacting against the contact surface formed by the third edge 125*c*, are deformed outwards so as to allow engagement, facilitated by the inclination of the free ends of the flat-pin legs 132. The shaped body 120, once the flat-lamina spring 130 engages with the second end 125 of the shaped body 120, arranges with three engaging points respectively corresponding to the point of engagement of the first tooth 124*b* with the DIN-standard rail B and the contact points of the flat-pin legs 132 pressing on the said rail B. This produces a reaction, which generates a contact force both on the second tooth 126 of second end 125 and on the tooth 124*a* of first end 124, as well as between the first and second sections 123*a*1, 123*a*2 of the bottom edge 123*a* and the top surfaces of the folded flanges B1,B2 of the DIN-standard rail B, and also between the flat-lamina spring 130 and the respective folded flange B2 of the DIN-standard rail B.

The three engaging points also ensure both static planarity, once engagement has been performed, and dynamic planarity, during deformation of the flat-pin legs 132 when performing engagement or disengagement, ensuring correct resting of the edge sections of the bottom edge 123*a* on the respective flanges of the rail B, with consequent use of the entire cross-section of the vertical body bottom section 123 for electrical conduction, of a high conductive contact surface area on the rail B for discharging to earth, as well as a stable and easy positioning of the shaped body 120 on the DIN-standard rail B.

Applying pressure on the flat-pin legs 132 in the opposite direction, outwards, produces an opposite deformation of the flat-pin legs of the flat-lamina spring 130, which allows easy disengagement of the grounding element from the rail B.

According to a preferred embodiment of the present subject matter, the longitudinal conductor lamina 110 has a central through-opening 111 in the vertical direction Z-Z. The opposite free ends of the conductor lamina 110 can form a tip 115 inclined upwards (FIG. 1) and designed to engage (FIG. 5) with a corresponding internal seat 18 provided on each flank 11*b* of the frame 11 of a switchboard terminal block 10, so as to stably fasten the conductor lamina 110 to the terminal block 10 frame 11.

Preferably, each tip 115 has an incision 115*a* designed to engage with a corresponding relief 18*a* in the seat 18 in order to axially retain the conductor lamina 110 when it undergoes an axial deformation owing to the thrust exerted in the vertical direction by a screw of a means for retaining the wire 2.

Figure 6:
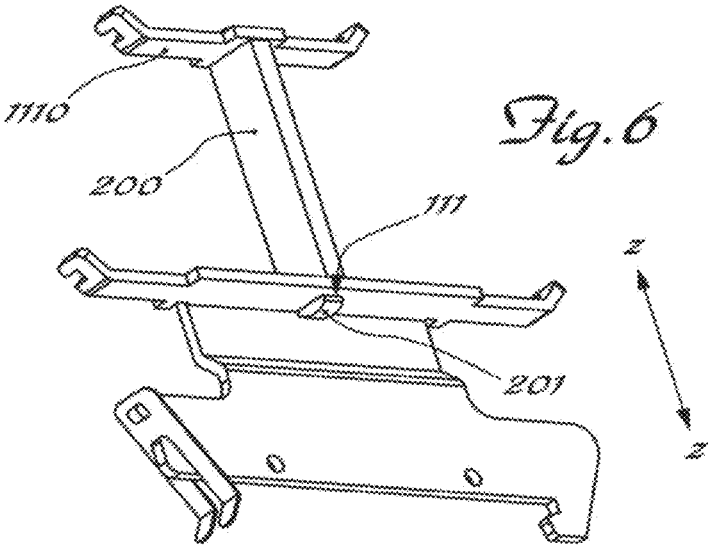
FIG. 6 shows a perspective view of a second preferred embodiment of the conductor element according to the present subject matter.

FIG. 6 shows a second embodiment of the conductor element according to the present subject matter, which envisages a connection with a second longitudinal conductor lamina 1110 arranged on a different level or tier in the vertical direction Z-Z. This embodiment envisages a column 200, preferably with a polygonal cross-section, having ends formed as a tooth 201 suitable for insertion inside the respective openings 111 and 1111 of the respective conductor lamina 110,1110 of the first and second tiers (e.g., upper tier and lower tier). It also envisages that the tooth 201 can have a length such as to protrude from the respective opening 111,1111 so that they may be stably riveted in order to provide a stable connection with the two conductor 110,1110.

Figure 5:
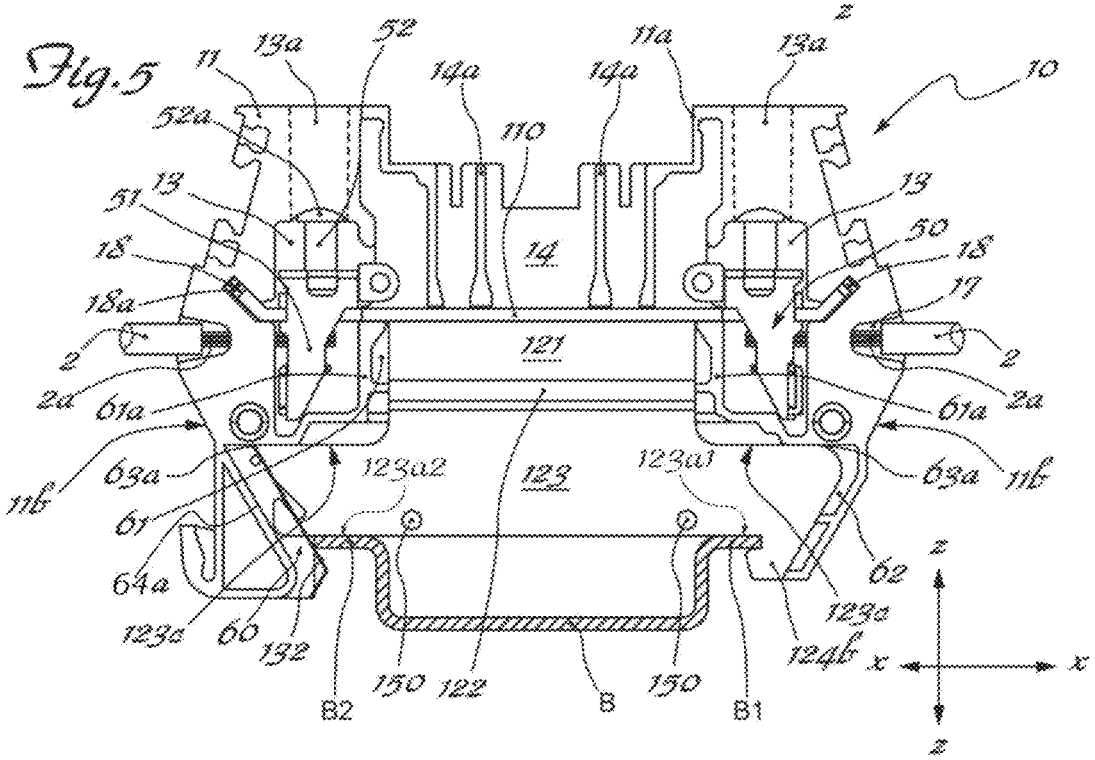
FIG. 5 shows a side view of an open terminal block with conductor element according to the present subject matter.
Figure 7:
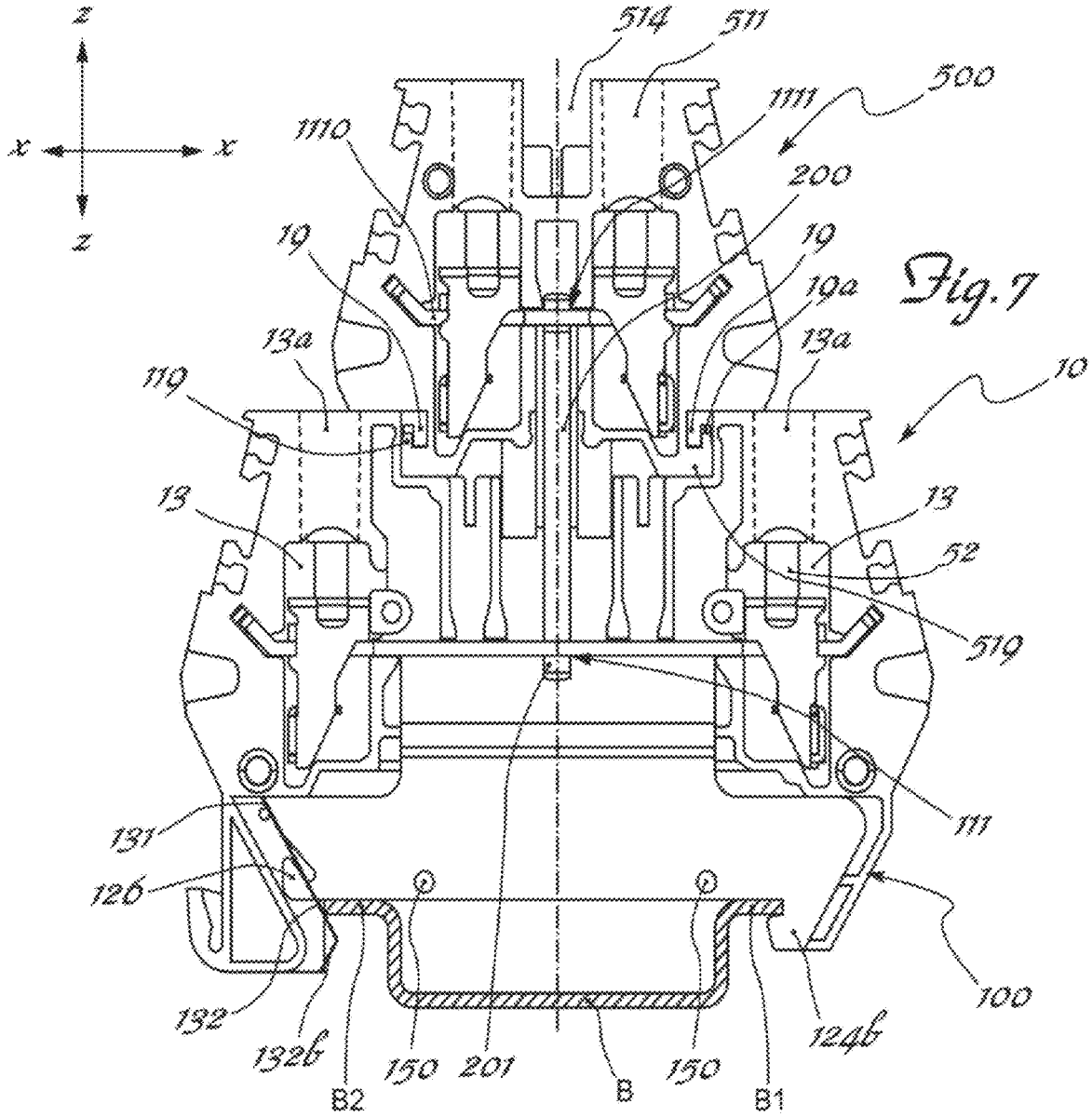
FIG. 7 shows a view of a two-tier terminal block open laterally with a conductor element according to FIG. 6.

FIGS. 5 and 7 show two switchboard terminal blocks 10, which have the appropriate seats for housing the corresponding conductor element, of the single tier and double tier type, inserted in the terminal block. The conductor element can have two centering elements 150, in the example two through-holes formed in the bottom section 123 and designed for coupling with corresponding pins formed in the of the terminal block 10.

The present subject matter also relates to a switchboard terminal block 10 suitable for grounding the grounding conductors connected to it and provided with a conductor element according to the present subject matter and described above.

In detail, the terminal block 10 includes an insulating frame 11, which forms the container of the conductor element and of means 50 for retaining the free end 2*a* of electric wires 2. For the sake of convenience of description and with reference to the directional layout shown by way of example, a bottom part corresponding to the part for engagement with a DIN-standard rail B fixed to the electric switchboard (not shown) and a top part visible to the user, opposite to the bottom part, will also be assumed. During use, the top part will correspond to the front visible side of the terminal block 10 mounted on the DIN-standard rail B.

In greater detail, insulating frame 11 is substantially in the form of a closed ring and formed so as to define at least one front end side 11*a* and at least two respective flanks 11*b* for inserting wires 2 arranged opposite to each other in the longitudinal direction X-X.

The frame 11 has, formed inside it, at least one pair of seats 13 and a bottom seat 60. The one pair of seats 13 is for housing the means 50 for retaining/releasing the wires 2. The bottom seat 60 is for housing the shaped body 120 of conductor element E. Bottom seat 60 is open at the bottom on the side for engagement with the rail B and is formed with a shape substantially matching that of the shaped body 120.

In greater detail a preferred bottom seat 60 has a first top seat 61 and a second bottom seat 62. The first top seat 61 has a smaller dimension in the longitudinal direction X-X corresponding to the length of the top and second sections 121 and 122 of the shaped body 120 and is bounded by vertical partitions 61*a* having a height in the vertical direction Z-Z substantially corresponding to the height of the said top and second sections 121;122. The second bottom seat 62 is for housing the bottom body section 123, with top inner edges, which have at least one section 63*a* extending in the longitudinal direction X-X parallel to the top longitudinal edges 123*c* of the bottom section 123 of the shaped body 120, so as to form reaction planes in the vertical direction Z-Z of the frame along the shaped body 120 bottom section 123 (and vice versa) during engagement/disengagement. Convex inner surfaces at the longitudinally outer ends of the edge sections 63*a* are formed to correspond to the outer edges of the shaped body 120 bottom section 123. In particular, a first surface 64*a* is parallel to the first edge 125*a* and extends in the vertical direction as far as the free ends of the flat-pin legs 132 of the flat-lamina spring 130, while the opposite inner surface complements the outer surface of the first end 124 with first tooth 124*b* of the vertical shaped body 120.

The front end side 11*a* of the frame 11 may also be provided with (see FIG. 5) holes 13*a* and a first aperture 14. The holes 13*a* can have a vertical axis Z-Z which is respectively aligned with one of said pair of seats 13 and can be designed to connect the latter with the exterior. The first aperture 14 can be centred along a vertical central axis Z-Z and bounded in the longitudinal direction X-X by respective first partitions 14*a* interrupted in the vertical direction Z-Z by a section having a height such as to allow insertion of the vertical shaped body 120 conductor first lamina 110 for restoring the electrical continuity between the opposite wires 2. Partitions 14*a* are spaced from each other in the longitudinal direction X-X by an amount such as to define a dimension of the aperture 14 suitable for housing circuit elements, for allowing connection, where necessary, of the vertical shaped body 120 to an auxiliary pole.

Each lateral flank 11*b* of the insulating frame 11 is provided with a respective opening 17 communicating with a respective one of the pair of seats 13 for housing the retaining/releasing means 50 for introducing the wire 2 in the longitudinal direction X-X. In the example shown in FIG. 5, the means 50 for retaining the electric wire 2 have a clamp 51 with actuating screw 52. The head 52*a* of said screw 52 is accessible from the outside by means of the said hole 13*a* with vertical axis Z-Z through which it is possible to insert the operating tool for rotating the screw, the tip of which, reacting against the surface of the conductor lamina 110, recalls the clamp 51, which grips the end of the wire 2 between clamp 51 and conductor lamina 110.

Although not shown, it is envisaged that the means for retaining the wire 2 may be of the spring type.

As shown, the laterally open terminal block 10 is assembled by: inserting inside frame 11 (in the transverse direction Y-Y) the conductor element according to the present subject matter so that the opposite inclined tips 115 of the conductor lamina 110 and the vertical shaped body 120 enter into the respective seats 18,60 of the insulating frame 11 of terminal block 10; and the means 50 for retaining the wire 2 inside the respective seat 13; closing the terminal block with a cover, not shown; inserting the wires 2 inside the respective opening and operating the actuating screw 52 of the retaining means 50 so as to grip the said wires 2 against the conductor lamina 110; and inserting any further circuit elements inside the respective seats.

Owing to the particular arrangement of the second end 125 and the flat-lamina spring 130 connected to it, the assembled terminal block 10 may be easily engaged/disengaged with/from the DIN-standard rail B merely by means of pushing/pulling in the vertical direction Z-Z.

FIG. 7 shows a second preferred embodiment of the terminal block according to the subject matter, which has a pair of teeth 19 in the form of an "overturned L" formed on the outermost wall of the opposite vertical edges of a front recess formed in the front end side 11*a* of the insulating frame of the terminal block 10. Teeth 19 form a respective L-shaped inset seat 19*a* provided in the respective vertical edge of the recess.

The teeth 19 with respective seat 19*a* are designed to receive corresponding projections 119 projecting outwards in the longitudinal direction X-X and formed in the bottom part of the frame 511 of an upper-tier terminal block 500 having lengthwise dimensions in the axial direction X-X smaller than those of the lower-tier terminal block 10. The longitudinal dimension of the upper-tier terminal block 500 is such as to leave exposed the hole 13*a* for access to the screw 52 for actuating the means 50 for gripping the bottom wires 2 against the vertical shaped body 120 first conductor lamina 110.

The joining together in the transverse direction Y-Y of the two frames 11 and 511 of the terminal blocks 10,500 produces an assembly with two tiers, i.e. upper tier and lower tier according to the non-limiting directional layout shown in the figure—suitable for housing a two-tier conductor element such as that shown in FIG. 6.

The upper-tier terminal block 500 has a structure and component parts similar to those of the lower-tier terminal block and is therefore not described in detail.

It is therefore clear how the conductor element for switchboard terminal blocks according to the present subject matter allows easy, rapid and safe reversible connection with the flanges of a DIN-standard switchboard rail. In addition, the terminal block according to the present subject matter provided with this conductor element may in turn be easily handled by the user in a safe, repeatable and easy manner for engagement/disengagement with/from the DIN-standard rail.

As used above and solely for easier description and without a limiting meaning, a set of three reference axes is assumed, respectively extending in a longitudinal direction X-X, corresponding to a lengthwise dimension of the grounding conductor element, transverse direction Y-Y, corresponding to a width or thickness of the grounding conductor element, and vertical direction Z-Z, corresponding to a heightwise dimension of the conductor element according to the present subject matter.

The invention claimed is:

1. A conductor element for switchboard terminal blocks comprising a conductor body, the conductor element comprising:

a conductor lamina extending in a longitudinal direction and designed to electrically connect together two wires in the longitudinal direction;

a substantially vertical shaped body extending in the longitudinal direction, connected to the conductor lamina and having a bottom body section, the bottom body section including:

a bottom free edge extending in the longitudinal direction, the bottom free edge including a first edge section for resting in a vertical direction on a first flange of two folded flanges of a DIN-standard rail;

a first end proximal to said first edge section and including a bottom edge having a first tooth for engaging with the first flange of the DIN-standard rail;

a second end opposite to the first end;

wherein the bottom free edge has a second edge section proximal to said second end and aligned in the vertical direction with the first edge section, for conductively resting in the vertical direction on a second flange of the two folded flanges of the DIN-standard rail;

a flat-lamina spring including a head and two flat-pin legs which are separated by an interspace;

wherein said second end is adapted to engage and retain the flat-lamina spring; and wherein the respective free ends of the two flat-pin legs are resiliently deformable so as to be arranged, during use, to contact and push on the second folded flange of the DIN-standard rail for engaging therewith, and to allow operation of the flat-lamina spring for disengagement from the rail.

2. The conductor element according to claim 1, wherein the free ends of the legs of the flat-lamina spring form a respective tongue inclined outwards at a suitable angle and facilitating engagement or disengagement of the conductor element with or from the rail.

3. The conductor element according to claim 1, wherein said second end for coupling with the flat-lamina spring has a first edge inclined at a suitable angle with respect to a top, horizontal, longitudinal edge parallel to the bottom free edge resting on the rail.

4. A conductor element according to claim 3, wherein the first edge has a pin extending outwards in the longitudinal direction for engagement with a respective opening in the head of the flat-lamina spring.

5. The conductor element according to claim 3 wherein said second end for coupling with the flat-lamina spring has a second edge inclined inwards at a suitable obtuse angle with respect to the first edge and connected to a second tooth for engagement with the head of the flat-lamina spring.

6. The conductor element according to claim 5, wherein said second tooth has an inner edge connected to the second edge and parallel to the first edge and an outer edge substantially parallel to the vertical direction.

7. The conductor element according to claim 1 wherein the bottom free edge of the bottom body section is arranged in a vertical plane within the width of the conductor lamina in a transverse direction.

8. The conductor element according to claim 7, wherein said substantially vertical shaped body comprises:

a first substantially vertical section with a top edge connected in the transverse direction to a longitudinal edge of the conductor lamina;

a second section inclined with respect to the first substantially vertical section from a top downwards and from the longitudinal edge towards a free edge of the conductor lamina at a suitable angle Ω; wherein the bottom body section has a top edge connected to the second section and the free bottom edge for resting on the rail.

9. The conductor element according to claim 1, further comprising a second longitudinal conductor lamina arranged on a different tier in the vertical direction with respect to the conductor lamina.

10. The conductor element according to claim 9, further comprising a conducting column extending in the vertical direction for electrically connecting together the conductor lamina and the second longitudinal conductor lamina.

11. The conductor element according to claim 10, wherein the opposite ends of the conducting column form a third tooth for insertion inside respective openings in the respective conductor lamina and the second longitudinal conductor lamina.

12. The conductor element according to claim 11, wherein the first tooth, the second tooth, and the third tooth each have a length such as to protrude from respective openings and are riveted for stable joining together with the respective conductor lamina and the second longitudinal conductor lamina.

13. A switchboard terminal block comprising a conductor element, the conductor element including a conductor body comprising:

a conductor lamina extending in a longitudinal direction and designed to electrically connect together two wires in the longitudinal direction;

a substantially vertical shaped body extending in the longitudinal direction, connected to the conductor lamina and having a bottom body section, the bottom body section including:

a bottom free edge extending in the longitudinal direction, the bottom free edge including a first edge section for resting in a vertical direction on a first flange of two folded flanges of a DIN-standard rail;

a first end proximal to said first edge section and including a bottom edge having a first tooth for engaging with the first flange of the DIN-standard rail;

a second end opposite to the first end; wherein the bottom free edge has a second edge section proximal to the second end and aligned in the vertical direction with the first edge section, for conductively resting in the vertical direction on a second flange of the two folded flanges of the DIN-standard rail; and a flat-lamina spring including a head and two flat-pin legs separated by an interspace;

wherein said second end is adapted to engage and retain the flat-lamina spring; and wherein the respective free ends of the two flat-pin legs are resiliently deformable so as to be arranged, during use, to contact and push on the second folded flange of the DIN-standard rail for engaging therewith, and to allow operation of the flat-lamina spring for disengagement from the rail.

14. The switchboard terminal block according to claim 13, further comprising a substantially closed-ring insulating frame configured to define at least one front end side and at least two respective flanks for inserting wires, opposite to each other in the longitudinal direction, said insulating frame forming a container of the conductor element and of a means for retaining the end of the two wires.

15. The switchboard terminal block according to claim 13, wherein the insulating frame further comprises at least one pair of seats for housing the means for retaining the end of the two wires and a bottom seat which is formed with a shape substantially complementing the substantially vertical shaped body so as to contain the substantially vertical shape body, and is open at the bottom on the side for engagement with the rail.

16. The switchboard terminal block according to claim 15 said bottom seat comprising:

a first top seat having a smaller dimension in the longitudinal direction corresponding to the length of a substantially vertical top section and second section of the substantially vertical shaped body and bounded by vertical partitions having a height in the direction substantially corresponding to the height of the substantially vertical top section and of the second section;

a second bottom seat for housing the bottom body section, with top inner edges which have at least one section extending in the longitudinal direction parallel to the top longitudinal edges of the bottom body section of the shaped body, so as to form reaction planes in the vertical direction of the insulating frame on the bottom body section during engagement or disengagement.

* * * * *